US005212920A

United States Patent [19]

Tye

[11] Patent Number: 5,212,920

[45] Date of Patent: May 25, 1993

[54] STRONGBACK ATTACHMENT SYSTEM FOR CONCRETE PANEL TILT-UP CONSTRUCTION

[75] Inventor: Dennis W. Tye, Hayward, Calif.

[73] Assignee: Richmond Screw Anchor Company, Inc., Fort Worth, Tex.

[21] Appl. No.: 671,550

[22] Filed: Mar. 19, 1991

[51] Int. Cl.[5] ..... E02D 35/00

[52] U.S. Cl. ..... 52/127.1; 52/706; 52/707; 52/127.7; 52/678; 249/91

[58] Field of Search ..... 52/127.1, 127.3, 127.7, 52/678, 704, 705, 706, 707; 249/91, 93, 96, 97

[56] References Cited

U.S. PATENT DOCUMENTS 3,431,012 3/1969 Courtois et al. ..... 52/706

*Primary Examiner*—Carl D. Friedman
*Assistant Examiner*—Wynn E. Wood
*Attorney, Agent, or Firm*—Natan Epstein

[57] ABSTRACT

A fastener system for temporarily securing a reinforcing beam or the like to a poured concrete structural member includes an anchor to be set in poured concrete with an exposed handle portion free of said concrete, and a shaft with a slotted end for receiving the handle portion. A spring loaded pin in the slot retains the handle portion in interlocking engagement with the shaft. An opposite end of the shaft secures a strongback beam to the concrete structure.

17 Claims, 2 Drawing Sheets

STRONGBACK ATTACHMENT SYSTEM FOR CONCRETE PANEL TILT-UP CONSTRUCTION

BACKGROUND OF THE INVENTION

Field of the Invention

The present invention pertains generally to the field of poured or cast concrete construction and in particular pertains to devices used to attach so called strongback beams to horizontally cast panels prior to reinforce and preserve the panel against fracture or damage during tilt-up.

State of the Prior Art

A widely practiced technique for quickly erecting concrete structures involves the use of a previously finished floor of the building as the curing surface upon which new slabs or panels, to be used as wall components, are formed. The floor is covered with paper or other sheet material treated with a release agent which prevents adhesion of freshly poured concrete to either the sheet covering or the underlying floor. A suitable frame is assembled on the covered floor to define the margins or edges of the slab to be formed. Fresh concrete is then poured into the form to cast the wall panel.

In typical construction, the floor used as the casting surface is quickly filled with new wall panels which must be erected in order to make space for the casting of more wall sections. The need to clear the working area precludes allowing the wall sections to cure the time necessary to achieve maximum strength. Consequently the wall sections must be tilted up into final erect position in a relatively fragile condition which necessitates that these panels be handled with considerable care and, in particular, that they not be subject to shock or excessive bending under their own weight as they are tilted from a horizontal to a vertical position.

It is common practice in the industry to attach temporary reinforcements, known as "strongbacks", by which additional rigidity is provided during panel tilt up. At present, commonly used strongbacks involve heavy lumber or steel beams which are attached to the wall section by cumbersome hardware which requires time consuming installation. Because of the complexity of this operation, strongback installation must be planned and completed well in advance of the hoisting of the wall sections to their installed position, to avoid costly delays and disruptions in the construction schedule.

For this reason, improvement is needed in strongback attachment devices and systems, to allow quick, easy and dependable attachment and detachment of strongback reinforcements in order to speed up the hoisting and installation of tilt-up precast concrete panels and similar construction techniques.

SUMMARY OF THE INVENTION

In response to the aforementioned needs, the present invention provides a simple, reliable and easy-to-use attachment system for temporarily securing a reinforcing beam, strongback or the like to a precast structural member, particularly in tilt-up concrete panel construction.

The fastener system of this invention includes two main components which cooperate to facilitate quick and simple attachment and removal of strongback reinforcements to concrete tilt-up panels, so that the strongback installation can be carried out immediately prior to hoisting of the panel without significant delay or interference with the hoisting operation. The two components are an anchor insert which is set into the concrete panel, and a threaded shaft one end of which engages the insert.

The anchor insert is made, for example, of heavy gauge steel wire, which is partially embedded in the concrete panel, leaving a portion of the insert accessible within a cavity defined in the panel by means of a disposable plastic void, which keeps the fluid concrete from fully encasing the insert.

The threaded shaft is machined at one end to make a fastener head adapted to releasably engage the exposed portion of the embedded insert. The free end of the threaded shaft can be attached to a strongback beam by means of nuts or equivalent hardware. A strongback beam can be attached to a panel by means of two or more such shafts anchored to the panel along the length of the beam, and more than one strongback may be used for a single panel.

The fastener head on the threaded shaft may be a press-in type fastener which interlocks with and engages the exposed portion of the anchor insert. The press-in fastener includes a diametric slot in the shaft end dimensioned to receive the exposed portion of the anchored insert, a pair of hook elements adjacent to the slot and oriented to engage the anchor insert by a twist of the shaft about its long axis, and a spring loaded pin which retains the anchor insert in engagement with the hook elements to avoid premature disengagement of the shaft from the anchor insert. The retaining pin is movable within an axial bore in the shaft and is biased by a spring captive within the bore. The hook elements may be machined integrally with the shaft by defining arcuate lateral slots communicating with diagonally opposite ends of the diametric slot.

In a presently preferred form of the invention, the anchor insert is a frame assembled of welded metal rod, preferably made of three welded elements: a central U-shaped section and a spacer segment attached to each end of the central section for supporting the central U-shaped section in inverted upright position on the concrete pouring form or surface. A void element is used to cover the inverted U portion during pouring and setting of the concrete. Once the concrete is hardened, the void element is removed and discarded to expose the upper portion of the inverted U section of the anchor insert protruding in a cavity defined in the hardened concrete. This exposed portion of the insert presents a closed half loop of heavy wire or steel rod which can be engaged by the fastener head on the threaded shaft.

DETAILED DESCRIPTION OF THE PREFERRED EMBODIMENTS

Figure 1:
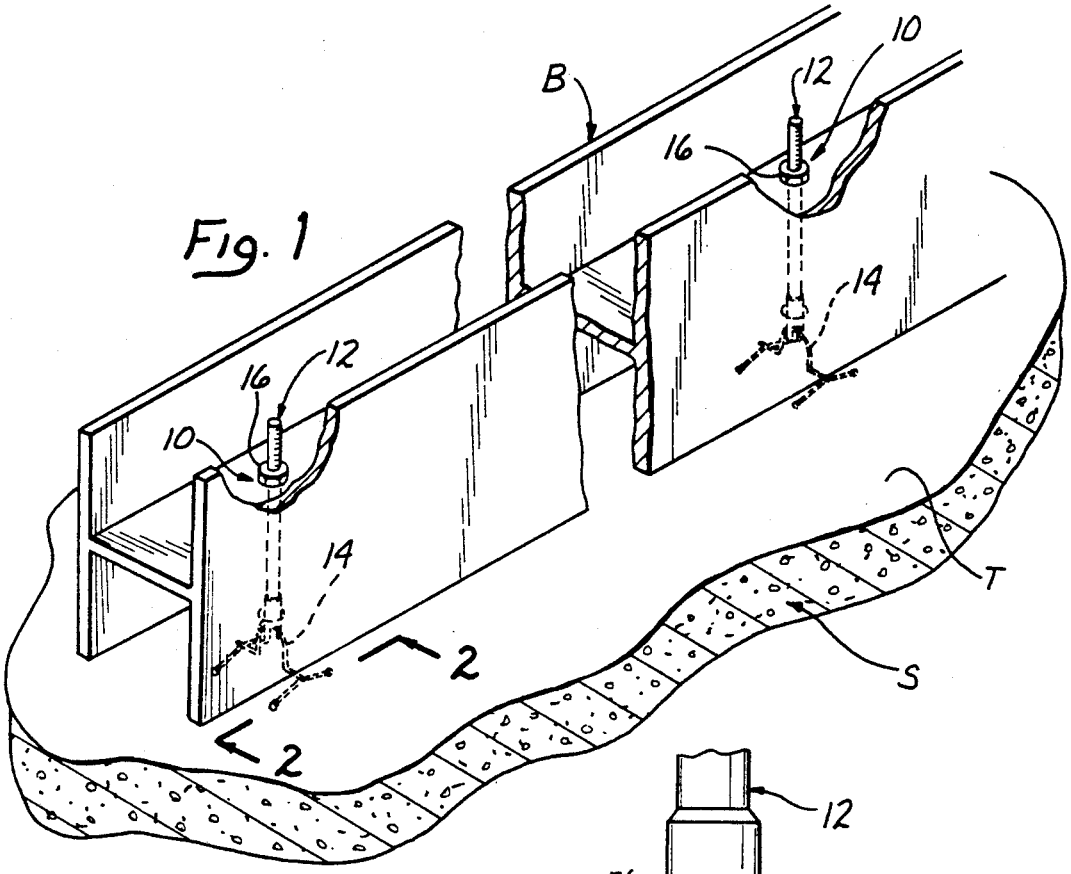
FIG. 1 is a perspective view showing a typical I-beam strongback reinforcement secured to a concrete slab by two spaced-apart fasteners according to this invention.

With reference to the attached drawings, FIG. 1 shows a concrete slab S with a plane top surface T. The slab S is in a horizontal position and is to be hoisted or tilted-up to a vertical installed position. In order to reinforce slab S during the hoisting operation a strongback B, which is an I-beam of aluminum or other suitable material, is secured against the surface T of the slab S to provide additional rigidity to the slab while it is tilted from a horizontal to a vertical condition. The strongback B is secured to slab S by means of fasteners each of which is generally designated by the numeral 10. Two fasteners 10 are shown spaced along the length of the beam B, although a greater number may be used for a particular beam, as may be needed.

Each fastener 10 consists of three separate elements which together cooperate to secure the strongback B to the slab S. The three elements comprising the fastener assembly 10 are a threaded shaft 12 which is engaged at its lower end to an anchor insert 14 partially embedded in the slab S, and a nut 16 threaded onto the shaft 12 to hold the strongback B against slab surface T. The threaded shaft 12 passes through a hole in the strongback beam B so that a free end of the shaft 12 extends above the beam, and the nut 16 is threaded onto the free end and tightened against the beam to hold the latter against the slab S.

Figure 2:
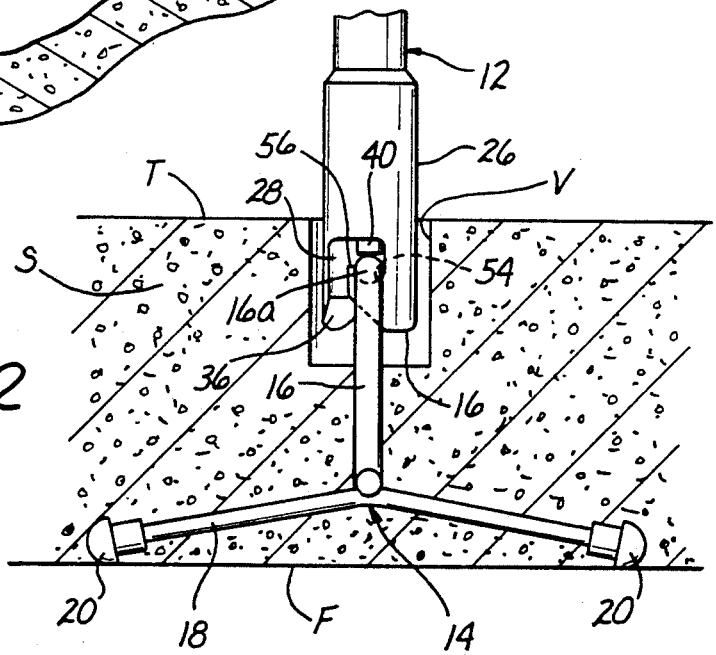
FIG. 2 is a side elevational view showing the fastener head end of the threaded shaft engaged to the anchor insert set in the concrete slab, shown in vertical section.

Turning now to FIG. 2, the concrete slab S is shown in vertical section between its top surface T and a bottom surface F, and an anchor insert 14 is set in the concrete mass of the slab. The anchor insert 14 is a frame assembled from heavy gauge steel wire or rod stock, and as better seen in FIGS. 3 and 4, includes a center section 16 bent into a U-shape, the ends of which are welded to two standoffs 18 such that the U-shaped portion is supported in a vertical plane transverse to the standoffs with the closed end of the U oriented upwardly. Each standoff 18 is a rod segment provided with plastic feet 20 at both ends, bent to a shallow, obtuse angle at its center, and welded to the center section 16 at the apex of its angle. The two standoffs thus provide four legs which support the inverted U-shaped center, and which anchor the exposed portion of the insert to the cast concrete slab.

An insert 14 is placed on the bottom of the slab form at each location where a fastener 10 is to be attached to a strongback reinforcement B. A void form of suitable shape and configuration (not shown) is fitted over the handle shaped center section 16 so as to cover about the upper half of the inverted U portion, leaving exposed the remainder of the insert 14. Fluid concrete is then poured into the slab form to the desired thickness and allowed to harden. The void form is then pulled off the center section 16, leaving a cavity or recess V in the top surface T of the slab S, as seen FIG. 2. The top of the U section 16 of the insert 14 is a rod section 16*a* generally parallel to the slab casting surface and is exposed and accessible within the cavity V below the top surface T of the slab S, forming a half loop which is closed by the concrete bottom surface of the cavity V.

The anchor insert 14 makes contact with the underlying casting surface, i.e. the floor which serves as the bottom of the concrete form, only at four points i.e. the four plastic feet 20. When embedded in concrete, the exposed metal surfaces of the standoffs 18 are encased by the concrete and only small portions of the plastic feet 20 appear at the slab surface F, as seen in FIG. 2. These small areas of exposed plastic are easily painted over and do not detract from the appearance or structural integrity of the slab of the surface F. Also, the plastic is inert and will not deteriorate significantly by exposure to the elements. The metal standoffs 18 are embedded deeper in the concrete and are consequently protected against corrosion, etc.. The cavity V is eventually filled, after installation of the panel S, with a suitable inert filler to likewise prevent deterioration of the portion of the insert 14 exposed in the cavity V.

Figure 5:
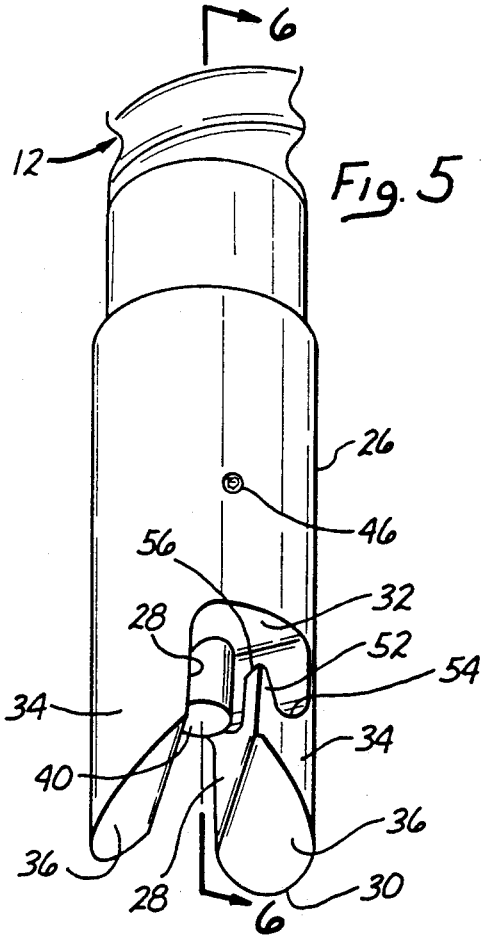
FIG. 5 is a close-up perspective view of the fastener head of the threaded shaft.
Figure 6:
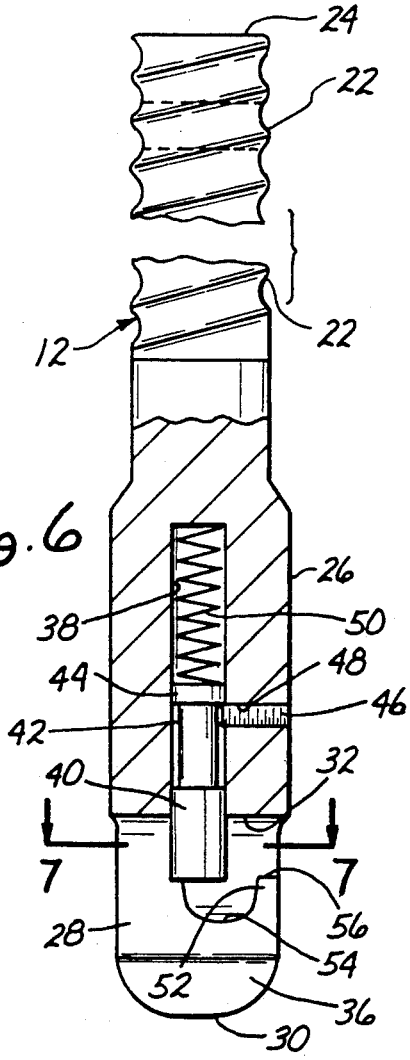
FIG. 6 is a side elevational view of the threaded shaft, broken away to show the fastener head in longitudinal section along line 6—6 in FIG. 5.

Turning now to FIGS. 5 and 6, the shaft 12 has a male thread 22 which terminates at an upper end 24 of the shaft. The lower end of the shaft has a cylindrical fastener head 26 which is machined integrally with the threaded portion of the shaft 12. A diametric slot 28 is cut into the lower end 30 and terminates in an end wall 32. The slot 28 divides the cylindrical head 26 into two prongs 34 with beveled end surfaces 36 which spread outwardly from the slot 28 in a V configuration for guiding the slot 28 into engagement with the center section 16 of the anchor insert 14, as illustrated in FIG. 3.

A cylindrical pin 40 is reciprocable within an axial blind bore 38 which opens in the end wall 32 of the diametric slot 28. The pin 40 has neck 42 of reduced diameter and an end cap 44 which is of diameter equal to the pin 40. A set screw 46 is threaded into a radial bore 48. The set screw 46 is advanced into the axial bore 28 short of contact with the neck 42, but into axial interference with both the end cap 44 and pin 40. The inner end of the set screw 46 thus acts to stop the pin 40 at an extended position, shown in FIGS. 5 and 6, where the end cap 44 is stopped against the set screw 46 and prevents the pin from leaving the bore 28. A coil spring 50 is in compression between the blind end of the axial bore 38 and the end cap 44, urging the pin 40 into the diametric slot 28, to its extended position as shown in FIG. 6.

Figure 7:
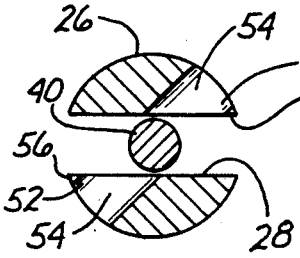
FIG. 7 is a cross-sectional of the shaft fastener head taken along line 7—7 in FIG. 6.

The fastener head 26 also includes a pair of integral hook elements 52 which are arranged on opposite sides of the diametric slot 28 and at opposite ends of the slot 28, in diagonally opposed relationship. Each hook 52 is defined by an arcuate lateral slot 54 which extends from the slot 28, first transversely to the shaft axis and then turns at a right angle to an axial direction towards the lower end 30 of the fastener head 26. Each slot 54 defines a curved hook 52 which terminates in a point 56, which points along the axis of the shaft 12 towards its upper end 24, as shown in FIGS. 5, 6 and 7. The two lateral slots 54 together define a keyway which extends diametrically through the fastener head 26, at approximately 45 degrees to the diametric slot 28 in a plane transverse to the shaft axis, as best seen in FIG. 7. The widths of slot 28 and keyway 52 are such as to closely receive the thickness of the rod or wire of the center section 16 of the insert anchor 14.

Figure 3:
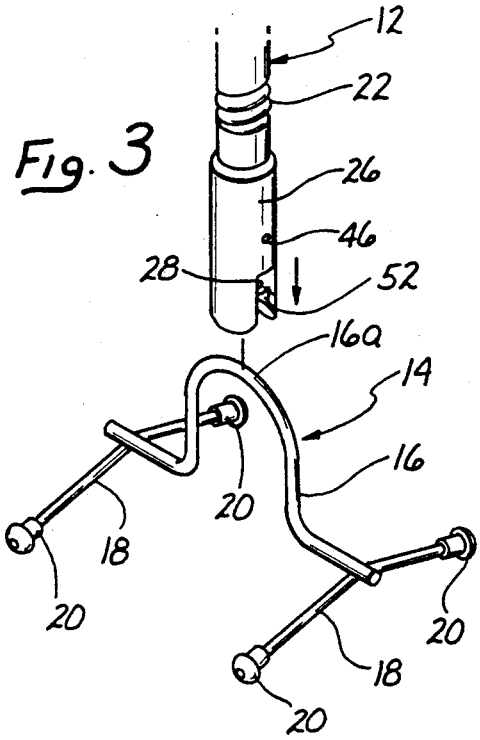
FIG. 3 is a perspective view showing the fastener head of the threaded shaft prior to engagement with the anchor insert.
Figure 4:
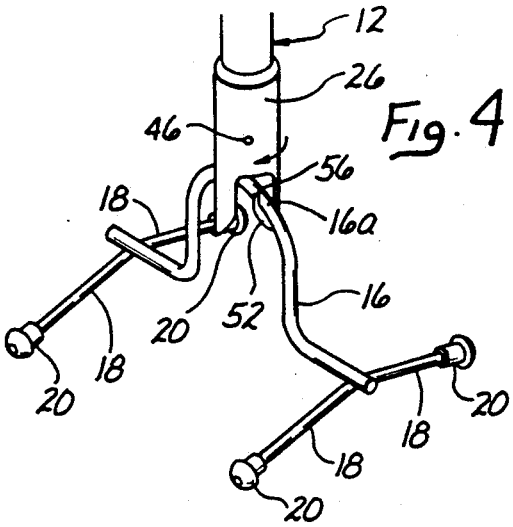
FIG. 4 is a view as in FIG. 3 showing the fastener head of the threaded shaft engaged to the anchor insert.

Engagement of the fastener head 26 to the anchor insert 14 is shown in the sequence of FIGS. 3 and 4. The fastener head 26 is lowered into the cavity V in the slab S with the diametric slot 28 in alignment with the exposed horizontal portion 16*a* of the insert 14 which lies transverse to the shaft axis. The fastener head is pushed against the insert portion 16*a* until the pin 40 is driven back into the axial bore 38 against the urging of spring 50, and the portion 16*a* makes contact with the end wall 32 of the slot 28. The shaft 12 is then turned clockwise about its axis, as indicated by the arrow in FIG. 4, to move the section 16*a* into longitudinal alignment with the keyway 54. At this point, the portion 16*a* is still in contact with the end wall 32 and overlyies in spaced relationship the keyway surface indicated by the numerals 54 in FIGS. 5 thru 7. Axial force is now withdrawn from the shaft 12, allowing the spring 50, acting through pin 40, to move the insert section 16*a* into the bottom of the keyway 54. In actuality, the insert does not move, since it is set in the concrete slab; rather, the shaft 12 reacts to the bias of spring 50 and moves axially upwardly to bring the keyway surface against the insert section 16*a*. In an engaged condition of the shaft 12 with anchor insert 14 shown in FIGS. 1, 2 and 4, the insert section 16*a* is retained captive within the keyway 54 against accidental withdrawal therefrom by cooperation of the two hook elements 52 and retaining pin 40 under bias of spring 50.

Engagement of the shaft 12 with the anchor insert 14 is therefore simple, rapid and secure. Many shafts 12 can be quickly attached to a concrete slab provided with a sufficient number of embedded anchor inserts 14, and the strongback beams then fastened by means of nuts 16 threaded onto the free ends of the shafts 12, as shown in FIG. 1. A number of strongback beams B can be quickly and reliably fastened to a concrete slab S just prior to tilting of the slab to its installed position, and once installed, the strongback B can be just as rapidly and easily detached by removing the nuts 16, and separating the strongback beams B from the slab S. Each shaft 12 is then pushed against the anchor insert 14 to depress the retaining pin 14 into the bore 38 and to lift the insert section 16*a* out of the keyway 54 and up against the end wall 32. The shaft 12 is then turned about its axis in a direction opposite to that indicated by the arrow in FIG. 4 to bring anchor section 16*a* alignment with the diametric slot 28. The shaft 12 can then be pulled up and away from the insert 14. The shaft 12 and nut 16 are recovered after such use. The anchor insert 14 remains embedded in the concrete slab S. Each void or cavity V in the slab is then filled with a suitable filler material to create a smooth slab surface T and to prevent corrosion or deterioration of the metallic insert 14, which could lead to discoloration and other damage of the concrete material.

While a presently preferred embodiment of the invention has been described and illustrated for purposes of clarity and example, it must be understood that many changes, substitutions and modifications to the described embodiment will become apparent to those possessesed of ordinary skill in the art without departing from the scope and spirit of the present invention, which is defined by the following claims.

What is claimed is:

1. A fastener system for temporarily securing a strongback beam or the like to a poured concrete structural member, comprising:

an anchor having a first portion adapted to be set in said poured concrete and to support a connected handle portion free of said concrete; and a shaft having a threaded end and an opposite end having a fastener head adapted to releasably engage said handle portion of the anchor, said fastener head being integral with said shaft and comprising a diametric slot defined in said opposite end dimensioned to receive said handle portion, hook means defined by diametrically opposed lateral slots opening into said diametric slot on either side thereof, said lateral slots being shaped for receiving and retaining said handle portion against withdrawal from said slot, and biasing means in said diametric slot normally urging said handle portion into retaining relationship with said hook means, said threaded end remaining free for securing a strongback beam to said structural member.

2. The system of claim 1 characterized in that said handle portion is engageable with said hook means by insertion into said slot against said biasing means followed by relative rotation between said shaft and handle portion about the shaft axis through a fraction of a revolution.

3. The system of claim 1 wherein said biasing means comprise a pin moveable within an axial bore in said shaft, and spring means in said bore urging said pin into said slot against said handle portion.

4. A fastener system for temporarily securing a reinforcing beam or the like to a poured concrete structural member, comprising:

an anchor having a first portion adapted to be set in said poured concrete and to support a connected handle portion free of said concrete; and a unitary shaft having one end divided longitudinally by keyway means extending diametrically through said shaft for admitting said handle portion into said keyway means, biasing means engaging said handle within said keyway means for urging said handle portion towards said one end and into retentive engagement with said keyway means, and an opposite shaft end engageable to a strongback beam for securing the strongback beam to said structural member.

5. The system of claim 4 wherein said handle portion is engageable with said keyway means by relative rotation of said shaft about its axis by a fraction of a revolution.

6. The system of claim 4 wherein said anchor is a frame of metal rod wherein said handle portion is shaped generally as an inverted U and said anchor comprises leg means adapted to support said handle portion upright on a concrete casting surface.

7. The system of claim 4 wherein said handle portion includes a segment adapted to extend diametrically across said shaft in said keyway means.

8. The system of claim 4 wherein said biasing means comprise a pin moveable within an axial bore in said shaft and spring means in said bore urging said pin against said handle portion.

9. The system of claim 4 wherein said opposite shaft end is threaded for engagement with internally threaded nut means.

10. The system of claim 4 wherein said keyway means include a diametric slot defined at said one end and at least one pair of lateral slots communicating with said diametric slot on opposite sides thereof such that said handle portion in engagement with said keyway means is diametrically transverse to said shaft.

11. The system of claim 10 wherein said biasing means comprise a pin moveable within an axial bore in said shaft and spring means in said bore urging said pin against said handle portion.

12. The system of claim 4 wherein said lateral slots extend at an angle to said diametric slot.

13. A retainer for interlocking to an anchor having a first portion adapted to be set in said poured concrete and to support a connected handle portion free of said concrete on a concrete casting surface, said retainer comprising:

a shaft having a longitudinally divided slotted end adapted to receive and engage the handle portion, said slotted end including keyway means integral with and extending diametrically through said shaft for releasably engaging said rod section and biasing means contained in said slotted end and acting against said handle portion for urging said handle portion into retentive engagement with said keyway means.

14. The fastener of claim 4 further comprising void means adapted to cover said handle portion during pouring of the concrete structural member thereby to define a cavity in the member with said handle portion exposed therein free of concrete for engagement by said one end of the shaft.

15. The system of claim 13 wherein said shaft has an opposite shaft end threaded for engaging internally threaded nut means.

16. A fastener system for temporarily securing a reinforcing beam or the like to a poured concrete structural member, comprising:

an anchor having a first portion adapted to be set in said poured concrete and to support a connected handle portion free of said concrete on a concrete casting surface;

a unitary shaft having a slotted end adapted to receive and engage said handle portion and an opposite shaft end, said handle portion including a rod section generally parallel to said casting surface, said slotted end including keyway means extending diametrically through said shaft for releasably engaging said rod section and biasing means within said slotted end for urging said rod section against disengagement from said keyway means;

bean retaining means engageable to said opposite shaft end for securing a strongback beam to said structural member.

17. The system of claim 16 wherein said beam retaining means comprise internally threaded nut means and said opposite shaft end is threaded for engaging said nut means.

* * * * *